US008951151B2

(12) United States Patent
Glowinski

(10) Patent No.: US 8,951,151 B2
(45) Date of Patent: Feb. 10, 2015

(54) GAME BALL

(76) Inventor: Theresa A. Glowinski, New Berlin, WI (US)

( * ) Notice: Subject to any disclaimer, the term of this patent is extended or adjusted under 35 U.S.C. 154(b) by 1282 days.

(21) Appl. No.: 12/053,129

(22) Filed: Mar. 21, 2008

(65) Prior Publication Data

US 2008/0234077 A1 Sep. 25, 2008

Related U.S. Application Data

(60) Provisional application No. 60/896,603, filed on Mar. 23, 2007.

(51) Int. Cl.
*A63B 43/00* (2006.01)
*A63B 43/06* (2006.01)
*A63B 71/06* (2006.01)

(52) U.S. Cl.
CPC ..... *A63B 43/06* (2013.01); *A63B 43/00* (2013.01); *A63B 2071/0625* (2013.01)
USPC ..... 473/570; 273/454; 473/571

(58) Field of Classification Search
USPC ..... 473/570, 571; 273/445, 446, 454, 432; 446/397, 398, 400
See application file for complete search history.

(56) References Cited

U.S. PATENT DOCUMENTS

| | | | | |
|---|---|---|---|---|
| 3,304,650 | A | 2/1967 | Glass et al. | |
| 3,580,575 | A * | 5/1971 | Speeth | 473/570 |
| 4,261,563 | A * | 4/1981 | Goldfarb | 463/7 |
| 4,309,030 | A * | 1/1982 | Goldfarb et al. | 463/7 |
| 4,403,777 | A * | 9/1983 | Del Principe et al. | 273/454 |
| 4,577,865 | A * | 3/1986 | Shishido | 473/570 |
| 4,595,200 | A * | 6/1986 | Shishido | 473/570 |
| 4,772,027 | A * | 9/1988 | Martel et al. | 273/237 |
| 4,874,165 | A * | 10/1989 | Steinberg et al. | 473/570 |
| 4,895,364 | A * | 1/1990 | Martel et al. | 273/237 |
| 4,961,579 | A * | 10/1990 | Thompson et al. | 273/460 |
| 4,991,847 | A | 2/1991 | Rudell et al. | |
| 5,236,383 | A * | 8/1993 | Connelly | 473/571 |
| 5,445,375 | A * | 8/1995 | Sweeny | 473/570 |
| D386,229 | S | 11/1997 | Hicks | |
| 5,779,576 | A | 7/1998 | Smith, III et al. | |
| 5,810,685 | A | 9/1998 | Willner et al. | |
| 5,888,156 | A * | 3/1999 | Cmiel et al. | 473/570 |
| 5,912,864 | A | 6/1999 | Maurer | |
| 6,005,204 | A | 12/1999 | Choi et al. | |
| 6,073,086 | A * | 6/2000 | Marinelli | 473/570 |
| 6,117,031 | A | 9/2000 | Malinauskas et al. | |
| 6,402,153 | B1 | 6/2002 | Stewart | |
| 6,422,942 | B1 * | 7/2002 | Jeffway et al. | 273/236 |
| 6,464,602 | B1 * | 10/2002 | Rottger | 473/571 |
| 6,578,527 | B1 | 6/2003 | Mathers | |
| 6,582,330 | B1 | 6/2003 | Rehkemper et al. | |
| 6,945,887 | B2 | 9/2005 | Oister et al. | |

(Continued)

OTHER PUBLICATIONS

Web Pages of ACAL Radiatron, Technical Article—Piezoelectric Sound Devices (5 pgs.), obtained at http://www.acal-radiatron.com/sonitron.php, Copyright ACAL Radiatron 1998-2007.

(Continued)

*Primary Examiner* — Steven Wong
(74) *Attorney, Agent, or Firm* — Whyte Hirschboeck Dudek S.C.

(57) ABSTRACT

A game ball and game for play by a plurality of players with a ball to be passed for player to player that emits a sound at different intervals from slow to rapid during a single play period to indicate to the players a stage of the game is provided.

8 Claims, 1 Drawing Sheet

(56) References Cited

U.S. PATENT DOCUMENTS

| | | | | |
|---|---|---|---|---|
| 7,022,036 | B2 * | 4/2006 | DuFlon et al. | 473/570 |
| 2001/0045765 | A1 | 11/2001 | Nelson | |
| 2003/0109339 | A1 | 6/2003 | Oister et al. | |
| 2003/0116917 | A1 * | 6/2003 | Thiemann | 273/378 |
| 2004/0127273 | A1 | 7/2004 | Englert et al. | |
| 2005/0070197 | A1 | 3/2005 | Benson | |
| 2005/0261083 | A1 * | 11/2005 | Liao | 473/570 |
| 2005/0278519 | A1 | 12/2005 | Luebke et al. | |
| 2006/0079355 | A1 | 4/2006 | May et al. | |
| 2006/0183577 | A1 | 8/2006 | DuFlon et al. | |
| 2007/0021244 | A1 * | 1/2007 | Ko | 473/570 |
| 2007/0218799 | A1 * | 9/2007 | Tobin | 446/27 |
| 2007/0281811 | A1 * | 12/2007 | Wang | 473/570 |
| 2009/0312127 | A1 * | 12/2009 | Kessler | 473/570 |

OTHER PUBLICATIONS

Web Pages of Lancaster's, Don, Tech Musings, obtained at http://www.tinaja.com/glib/muse113, Jun. 1997 (pp. 113.1-113.6).

Web Pages of Murata Manufacturing Co., Ltd., Piezoelectric Sound Components, Application Manual, (12 pgs.), obtained at http://www.murata.com/catalog/p15e6, downloaded Feb. 2007.

Web Pages of Piezo Buzzer (2 pgs.), obtained at http://www.kingstate.com.tw/9-2.htm, downloaded Feb. 5, 2007.

Web Pages of surplustraders.net, Vibrator Motors—For Sale (3 pgs.), obtained at http://www.73.com/a/0185.shtml, downloaded Feb. 6, 2007.

Web Pages of The Electronics Club, Other Components (4 pgs.), obtained at http://www.kpsec.freeuk.com/components/other.htm, Copyright John Hewes 2007.

Web Page of The Red Ferret Journal, Micro processor MSP430F20xx (1 pg.), obtained at http://www.redferret.net, downloaded Feb. 5, 2007.

Web Pages of The TI MSP430 microcontroller, obtained at http://eleceng.dit.ie/frank/msp430/msp430, undated (11 pgs.).

* cited by examiner

GAME BALL

CROSS-REFERENCE TO RELATED APPLICATION

This application claims priority under 35 U.S.C. §119(e) to Provisional Patent Application Ser. No. 60/896,603, filed on Mar. 22, 2007, the entire disclosure of which is hereby incorporated by reference.

TECHNICAL FIELD

Embodiments of the invention relate to game balls and, more particularly, to recreational sport balls.

BACKGROUND OF THE INVENTION

Sport related toys are very popular and millions of children and adults play pickup football, basketball and baseball, as well as hockey. Toy and sporting goods manufacturers have produce many products to make recreational sports more fun and safe for participants.

Ball tossing games are particularly popular with children and adults. One well-known throw-and-catch game is "hot potato" in which a ball or other object is quickly passed from player to player until a random time period expires or music stops, with the person holding the object at that time declared as "out."

It would be desirable to provide game ball for use in an entertaining ball tossing activity that will also promote physical activity.

BRIEF DESCRIPTION OF THE DRAWINGS

Embodiments of the invention are described below with reference to the following accompanying drawings, which are for illustrative purposes only. Throughout the following views, the reference numerals will be used in the drawings, and the same reference numerals will be used throughout the several views and in the description to indicate same or like parts.

DETAILED DESCRIPTION OF THE INVENTION

The following description with reference to the drawings provides illustrative examples of devices and methods according to embodiments of the invention. Such description is for illustrative purposes only and not for purposes of limiting the same.

Figure 1:
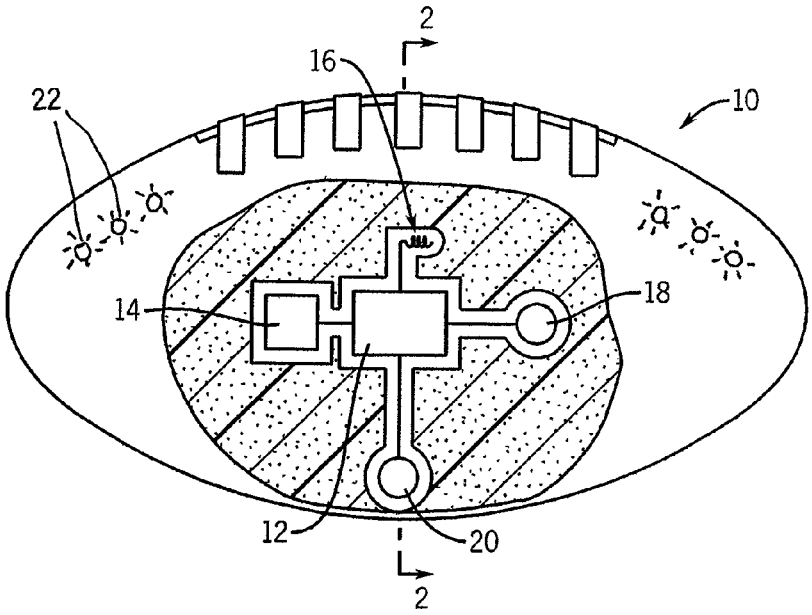
FIG. 1 is a partial cut-away view of an embodiment of a game ball of the invention in the form of football, illustrating schematically the internal components contained within the ball.
Figure 2:
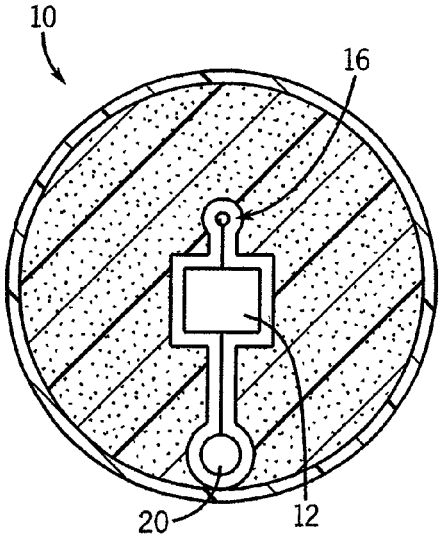
FIG. 2 is a cross-sectional view of the game ball of FIG. 1, taken along lines 2-2.

The invention provides a game ball having a size and shape adapted to be passed among a number of players. An embodiment of a game ball 10 according to the invention is illustrated in FIGS. 1-2. The ball is depicted in the form of a football having an ellipsoidal shape. Other embodiments can include spherical forms such as a basketball, baseball, or soccer ball.

The game ball can be used to provide hours of entertainment among children and adults, and is a fin physical alternative to playing video games and watching television. The game ball can also be used to promote friendly competition among individuals and can be used like a conventional foam football during a pickup tag or a tackle game.

In an embodiment of the invention, the game ball is composed of a resilient material with a solid foam interior covered by a thin neoprene material to enhance durability. An example of a suitable material is a soft, flexible open-cell foam polyurethane or polyether from which soft impact balls and the like are made commonly sold under the NERF® line of products (Parker Brothers).

Figure 3:
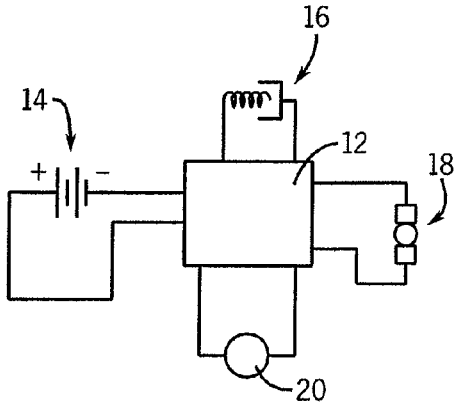
FIG. 3 is an embodiment of a schematic diagram of the electrical and/or electronic components contained within the ball of FIG. 1.

Housed in the interior of the game ball 10 are a microcontroller or microprocessor 12, a power source 14, a motion switch 16, and at least one of a sound generator 18, a vibration or motion generator 20 and a light generator (not shown). For proper weight and balance of the ball, the interior components are arranged along the axis and close to the center of the ball. FIG. 3 illustrates an embodiment of a schematic diagram of the electrical components of the game ball 10 in accordance with the present invention.

As illustrated, the motion switch 16 is connected to the microcontroller 12. The motion switch 16 is a motion responsive switch that is activated by moving the ball 10, for example, by picking up the ball and/or tossing the ball or, in some embodiments, by shaking the ball. An example of a suitable motion switch is a conventional ball sensor switch known in the art, which is structured with a spring having a fixed end and a free end and a metal cap or ball positioned proximate the free end of the spring for electrical engagement by the free end of the spring. Contact between the free end of the spring and the metal cap or ball closes an electrical circuit that generates a signal to the microcontroller 12.

An example of a suitable microcontroller 12 is a Texas Instruments (TI) MSP430 processor, which are low power 16 bit devices. The microprocessor 12 is electrically connected to the power source 14, which can be, for example, conventional batteries such as double A or triple A batteries or a long-lasting battery. In some embodiments, the microcontroller 12 incorporates internal counter/timer circuits that are used to generate random count periods for example, between 20-60 seconds (e.g., a 60-second count period, a 30-second count period, a 15-second count period, etc.). In other embodiments, a suitable logic and timing device such as a field programmable gate array (FPGA) or generic array logic (GAL) can be connected to the signaling devices. The timing feature allows the actual period of play to be an unknown variable.

The microcontroller 12 is also coupled to the sound generator 18 and/or the vibration generator 20 and/or a light generator (not shown), as known in the art. In some embodiments, the game ball 10 is structured with a microcontroller 12 coupled to a sound generator 18 and a light generator (not shown). As illustrated, the sound generator 18 can be mounted near the surface of the game ball to be clearly audible. The sound generator 18 can be, for example, a piezoelectric sound device such as a piezo speaker or a piezo buzzer, or other device capable of generating an audible sound such as a buzzing or beep. An example of a suitable vibration generator 20 is a pager vibrator or pager motor, cell phone vibrator, or other device capable of generating a physical signal (e.g., vibrate). Optionally, the ball 10 can include a light or a series or string of lights 22 embedded in or visible on the exterior surface and connected to the microcontroller. In some embodiments, the lights can be activated by a signal from the microcontroller to flash (e.g., in sequence) with a beeping sound and/or vibration. In embodiments of the game ball, the lights can be used in place of the sound generator and/or the vibration generator.

The design is such that the logic device will sense inactivity and switch itself off. Upon sensing activity, the logic will then switch itself back on, thus eliminating the need for an on/off switch to activate or turn off the device.

The game is played by two or more persons and the ball is passed or tossed from player to player in a modified version of the game "hot potato" to avoid having the ball when an alerting sound (e.g., rapid series of beeps) and/or vibrating mechanism is activated. At that time, the player holding the ball can be "smeared" by the other players (e.g., by tackling, tagging, etc.), or declared "out" or the "loser" of that particular play. In another variation, the player holding the game ball at the end of the play period would attempt to run to a "safe" spot or score a "touchdown" before being tagged or tackled by another player, with players keeping score.

To start the game, the game ball 10 is picked up by one person, which can activate the motion switch 16, which sends an electrical signal to the microcontroller 12 to start the timer. In some embodiments, the game ball 10 is shaken and/or tossed to activate the motion switch 16. The microprocessor also sends an electrical signal to the sound generator 18 such that, as the ball is being passed, a series of audible sounds (e.g., beeps or other sound) is generated to signal the various stages in the play of the game.

For example, during a first time period of the play, a steady series of beeps (or other sound) can be generated at a relatively low rate of speed (e.g., at 1 beep/second for 60-90 seconds). When the first time period expires, the microcontroller resets the timer and sends an electrical signal to the sound generator 18 to emit a series of beeps (or other sound) at an increased rate of speed for a random time period, which can be a shorter period of time (e.g., 1 beep/0.5 second for 30-60 seconds). When the second time period expires, the microcontroller resets the timer and sends a signal to the sound generator 18 to emit the sound at a further increased rate for a random time period (e.g., 1 beep/0.25 second or a continuous or rapid beeping sound for 10-15 seconds) to indicate the end of the play period. The microcontroller can further be configured to send a signal to a vibration generator 20 (where included in the game ball) to generate a vibrational motion, and/or a signal to a flashing light(s) 22 (where the game ball includes a light or series of lights).

After the third time period expires, picking up or otherwise moving the game ball 10 will then reactivate the motion switch 16 to restart the process by starting a new timing cycle and new play period, causing the players to quickly resume play and continue to pass the ball along.

The game ball allows individuals to play a more competitive and physical version of "hot potato" and can be used among neighborhood children and teens, as well as adults, at a variety of outdoor gatherings and events.

Although specific embodiments have been illustrated and described herein, it will be appreciated by those of ordinary skill in the art that any arrangement which is calculated to achieve the same purpose may be substituted for the specific embodiments shown. This application is intended to cover any adaptations or variations that operate according to the principles of the invention as described. Therefore, it is intended that this invention be limited only by the claims and the equivalents thereof.

What is claimed is:

1. A game ball, comprising a foam material and housing:

a microcontroller connected to a power source, a motion switch, a sound generator and a vibration generator, the microcontroller incorporating or connected to a timer;

whereupon movement of the game ball activates the motion switch to generate a signal to the microprocessor a) to start the timer for a first count period and to generate a first signal to the sound generator to emit a first series of sounds at a first interval;

b) upon expiration of the first count period, to reset the timer for a second count period and to generate a second signal to the sound generator to emit a second series of sounds at a second interval being faster than the first interval;

c) at the end of the second count period, to reset the timer for a third count period and to generate a third signal to the sound generator to produce a third series of beeps at a third interval being faster than the second interval; and d) upon said reset of the timer for the third count period, to generate a signal to the vibration generator to produce a vibrational motion at said third interval.

2. The game ball of claim 1, wherein the timer is an internal timer incorporated in the microcontroller.

3. The game ball of claim 1, wherein the microcontroller incorporates both a logic function and a timing function.

4. The game ball of claim 1, further comprising a light generator.

5. The game ball of claim 4, wherein upon said reset of the timer for the third count period, the microcontroller further generates a signal to the light generator to produce a flashing light at said third interval.

6. A game for play by a plurality of players comprising the ball of claim 1 to be passed from player to player and that emits a sound at different intervals from slow to rapid during a single play period to indicate to the players a stage of the game.

7. The game according to claim 6, wherein said ball further emits a flashing light to indicate the end of the game.

8. The game ball of claim 1, having no external on/off switch.

* * * * *